US010937377B2

(12) United States Patent
Chen

(10) Patent No.: US 10,937,377 B2
(45) Date of Patent: Mar. 2, 2021

(54) DRIVING METHOD AND DEVICE FOR DRIVING A LIQUID CRYSTAL DISPLAY PANEL, AND LIQUID CRYSTAL DISPLAY APPARATUS

(71) Applicants: HKC Corporation Limited, Guangdong (CN); Chongqing HKC Optoelectronics Technology Co., Ltd., Chongqing (CN)

(72) Inventor: Yu-Jen Chen, Guangdong (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/462,658

(22) PCT Filed: Oct. 27, 2017

(86) PCT No.: PCT/CN2017/107980
§ 371 (c)(1),
(2) Date: May 21, 2019

(87) PCT Pub. No.: WO2018/113411
PCT Pub. Date: Jun. 28, 2018

(65) Prior Publication Data

US 2020/0066218 A1 Feb. 27, 2020

(30) Foreign Application Priority Data

Dec. 23, 2016 (CN) ..... 201611213771.4

(51) Int. Cl.
*G09G 3/36* (2006.01)

(52) U.S. Cl.
CPC ..... *G09G 3/3607* (2013.01); *G09G 3/3611* (2013.01); *G09G 2320/028* (2013.01); *G09G 2320/0242* (2013.01)

(58) Field of Classification Search
None
See application file for complete search history.

(56) References Cited

U.S. PATENT DOCUMENTS

2006/0221030 A1* 10/2006 Shih ..... G09G 3/3611 345/88
2019/0348005 A1* 11/2019 Chen ..... G09G 3/3607

FOREIGN PATENT DOCUMENTS

CN 101009083 A 8/2007

* cited by examiner

*Primary Examiner* — Ifedayo B Iluyomade

(57) ABSTRACT

Disclosed are driving method and device for driving an LCD apparatus, as well as an LCD apparatus. The driving method includes: receiving an image to be displayed, obtaining a first pixel signal and positional information of each pixel, and looking up the first pixel signal to retrieve a first voltage panel driving signal of the pixel; determining whether each pixel is a first- or second-position liquid crystal pixel; when the pixel is a first-position pixel, computing a second pixel signal based on the first pixel signal and first voltage panel driving signal of the first-position pixel; otherwise when the pixel is a second-position pixel, computing a first luminance signal based on the first voltage panel driving signals of the second-position pixel and of the first-position pixels adjacent to the second-position pixel; and driving the pixels using the second pixel signal and the first luminance signal, respectively.

17 Claims, 8 Drawing Sheets

| | | | | | | | | |
|---|---|---|---|---|---|---|---|---|
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |
| R | R | R | R | R | R | R | R | R |

FIG. 2

| | | | | | | | | |
|---|---|---|---|---|---|---|---|---|
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |
| H | H | H | H | H | H | H | H | H |

FIG. 3

| | | | | | | | | |
|---|---|---|---|---|---|---|---|---|
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |

FIG. 4

| | | | | | | | | |
|---|---|---|---|---|---|---|---|---|
| L’ | R’ | L’ | R’ | L’ | R’ | L’ | R’ | L’ |
| R’ | L’ | R’ | L’ | R’ | L’ | R’ | L’ | R’ |
| L’ | R’ | L’ | R’ | L’ | R’ | L’ | R’ | L’ |
| R’ | L’ | R’ | L’ | R’ | L’ | R’ | L’ | R’ |
| L’ | R’ | L’ | R’ | L’ | R’ | L’ | R’ | L’ |
| R’ | L’ | R’ | L’ | R’ | L’ | R’ | L’ | R’ |
| L’ | R’ | L’ | R’ | L’ | R’ | L’ | R’ | L’ |
| R’ | L’ | R’ | L’ | R’ | L’ | R’ | L’ | R’ |
| L’ | R’ | L’ | R’ | L’ | R’ | L’ | R’ | L’ |

FIG. 6

| | | | | | | | | |
|---|---|---|---|---|---|---|---|---|
| R’ | R’ | R’ | R’ | R’ | R’ | R’ | R’ | R’ |
| R’ | L’ | R’ | R’ | L’ | R’ | R’ | L’ | R’ |
| R’ | R’ | R’ | R’ | R’ | R’ | R’ | R’ | R’ |
| R’ | L’ | R’ | R’ | L’ | R’ | R’ | L’ | R’ |
| R’ | R’ | R’ | R’ | R’ | R’ | R’ | R’ | R’ |
| R’ | L’ | R’ | R’ | L’ | R’ | R’ | L’ | R’ |
| R’ | R’ | R’ | R’ | R’ | R’ | R’ | R’ | R’ |
| R’ | L’ | R’ | R’ | L’ | R’ | R’ | L’ | R’ |
| R’ | R’ | R’ | R’ | R’ | R’ | R’ | R’ | R’ |

FIG. 7

| | | | | | | | | |
|---|---|---|---|---|---|---|---|---|
| R’ | R’ | R’ | R’ | R’ | R’ | R’ | R’ | R’ |
| R’ | L’ | R’ | L’ | R’ | L’ | R’ | L’ | R’ |
| R’ | R’ | R’ | R’ | R’ | R’ | R’ | R’ | R’ |
| R’ | L’ | R’ | L’ | R’ | L’ | R’ | L’ | R’ |
| R’ | R’ | R’ | R’ | R’ | R’ | R’ | R’ | R’ |
| R’ | L’ | R’ | L’ | R’ | L’ | R’ | L’ | R’ |
| R’ | R’ | R’ | R’ | R’ | R’ | R’ | R’ | R’ |
| R’ | L’ | R’ | L’ | R’ | L’ | R’ | L’ | R’ |
| R’ | R’ | R’ | R’ | R’ | R’ | R’ | R’ | R’ |

FIG. 8

| | | | | | | | | |
|---|---|---|---|---|---|---|---|---|
| $L_{(n-1)(m-1)}$ | $L_{(n-1)m}$ | $L_{(n-1)(m+1)}$ | L | L | L | L | L | L |
| $L_{n(m-1)}$ | $L_{nm}$ | $L_{n(m+1)}$ | L | L | L | L | L | L |
| $L_{(n+1)(m-1)}$ | $L_{(n+1)m}$ | $L_{(n+1)(m+1)}$ | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |
| L | L | L | L | L | L | L | L | L |

FIG. 9

| | | | | | | | | |
|---|---|---|---|---|---|---|---|---|
| 0.25 | 0.5 | 0.25 | 0.5 | 0.25 | 0.5 | 0.25 | 0.5 | 0.25 |
| 0.5 | 1 | 0.5 | 1 | 0.5 | 1 | 0.5 | 1 | 0.5 |
| 0.25 | 0.5 | 0.25 | 0.5 | 0.25 | 0.5 | 0.25 | 0.5 | 0.25 |
| 0.5 | 1 | 0.5 | 1 | 0.5 | 1 | 0.5 | 1 | 0.5 |
| 0.25 | 0.5 | 0.25 | 0.5 | 0.25 | 0.5 | 0.25 | 0.5 | 0.25 |
| 0.5 | 1 | 0.5 | 1 | 0.5 | 1 | 0.5 | 1 | 0.5 |
| 0.25 | 0.5 | 0.25 | 0.5 | 0.25 | 0.5 | 0.25 | 0.5 | 0.25 |
| 0.5 | 1 | 0.5 | 1 | 0.5 | 1 | 0.5 | 1 | 0.5 |
| 0.25 | 0.5 | 0.25 | 0.5 | 0.25 | 0.5 | 0.25 | 0.5 | 0.25 |

FIG. 10

DRIVING METHOD AND DEVICE FOR DRIVING A LIQUID CRYSTAL DISPLAY PANEL, AND LIQUID CRYSTAL DISPLAY APPARATUS

TECHNICAL FIELD

This disclosure relates generally to liquid crystal display technology, and more particularly relates to a driving method and a driving device for driving a liquid crystal display panel, as well as a liquid crystal display apparatus.

BACKGROUND

Most of the existing large-sized liquid crystal panels adopt the passive VA (vertical alignment) or IPS (in-plane switching) liquid crystal technology. Compared with the IPS liquid crystal technology, the VA liquid crystal technology has the advantages of high production efficiency and low manufacturing cost; but it has obvious defects in optical properties compared with the IPS liquid crystal technology. In particular, large-sized panels in general commercial applications require a relatively large viewing angle, but the VA-type liquid crystal driving often cannot meet the requirements of general market applications when it comes to the angular color shift issue, which negatively affects the promotion of the VA liquid crystal technology.

In the VA liquid crystal technology the typical solution to angular color shift consists in subdividing each of various RGB primary color pixels into a primary pixel and a secondary pixel and feeding different driving voltages to the primary and secondary pixels which are spatially arranged, hopefully remedying the defect of angular color shift. Such a pixels design, however, typically requires redesigning metal wires and thin film transistors for purposes of driving the secondary pixels, resulting in a sacrifice of the light-transmissive opening area, thus negatively affecting the panel's transmittance and leading to a direct increase in the cost of the backlight module.

SUMMARY

This disclosure provides a computing-device-implemented driving method for driving a liquid crystal display apparatus, which can reduce the angular color shift while improving the panel's transmittance and reducing the cost of the backlight module.

The computing-device-implemented driving method for driving a liquid crystal display apparatus that is provided herein includes the following operations. An image to be displayed is first received by a processor. Then the processor obtains a first pixel signal and associated positional information of each of multiple liquid crystal pixels, and further looks up the first pixel signal to retrieve a first voltage panel driving signal of the pixel. Based on the positional information, each of the multiple liquid crystal pixels is determined as to whether it is a first-position liquid crystal pixel or a second-position liquid crystal pixel. When the liquid crystal pixel is a first-position liquid crystal pixel, the first pixel signal and first voltage panel driving signal of the first-position liquid crystal pixel are based on to compute a second pixel signal. Otherwise when the liquid crystal pixel is a second-position liquid crystal pixel, the first voltage panel driving signals of the second-position liquid crystal pixel and of at least one first-position liquid crystal pixel adjacent to the second-position liquid crystal pixel are based on to compute a first luminance signal. The first-position liquid crystal pixel is then driven by the second pixel signal, while the second-position liquid crystal pixel is driven by the first luminance signal.

In one embodiment, computing the second pixel signal when the liquid crystal pixel is a first-position liquid crystal pixel includes substituting the relevant parameters into the following formula to compute the second pixel signal:

$$R'_{ij}=R_{ij}-L_{ij};$$

where i represents the row position information of the liquid crystal pixel in a liquid crystal panel and j represents the column position information of the liquid crystal pixel in the liquid crystal panel; $R'_{ij}$ and $R_{ij}$ represent respectively the second pixel signal and the first pixel signal of the first-position liquid crystal pixel; and $L_{ij}$ represents the first voltage panel driving signal of the first-position liquid crystal pixel.

Likewise, computing the first luminance signal when the liquid crystal pixel is a second-position liquid crystal pixel includes substituting the relevant parameters into the following formula to compute the first luminance signal:

$$L'_{nm}=a*L_{nm}+b*(L_{n(m-1)}+L_{n(m+1)}+L_{(n-1)m}+L_{(n+1)m})+c*(L_{(n-1)(m-1)}+L_{(n-1)(m+1)}+L_{(n+1)(m+1)}+L_{(n+1)(m-1)});$$

where n represents the row position information of the liquid crystal pixel in the liquid crystal panel and m represents the column position information of the liquid crystal pixel in the liquid crystal panel, while a, b and c denote weight factors; $L_{nm}$ and $L'_{nm}$ represent respectively the first voltage panel driving signal and the first luminance signal of the second-position liquid crystal pixel; $L_{n(m-1)}$, $L_{n(m+1)}$, $L_{(n-1)m}$, $L_{(n+1)m}$, $L_{(n-1)(m-1)}$, $L_{(n-1)(m+1)}$, $L_{(n+1)(m+1)}$, and $L_{(n+1)(m-1)}$ represent respectively the first voltage panel driving signals of the first-position liquid crystal pixels adjacent to the second-position liquid crystal pixel.

In one embodiment, the driving method further includes: if in computing the first luminance signal using the formula the corresponding liquid crystal pixel position of a first-position liquid crystal pixel in the formula doesn't exist in the liquid crystal panel, writing the corresponding first voltage panel driving signal of the non-existent liquid crystal pixel as 0.

In one embodiment, the weight factors a=1, b=0.5, and c=0.25.

In one embodiment, the driving method further includes: dividing the liquid crystal pixels in the liquid crystal panel into multiple array blocks, with each array block including four liquid crystal pixels adjacent to each other; and setting any one liquid crystal pixel in each block as a second-position liquid crystal pixel of the block, and arranging the second-position liquid crystal pixel in each block in a same position relative to the at least one first-position liquid crystal pixel in the block.

This disclosure also provides a driving device for driving a liquid crystal display apparatus. The driving device includes a non-volatile memory that stores executable instructions and a processor that executes the executable instructions, the executable instructions including: an acquisition module that receives an image to be displayed, obtains a first pixel signal and associated positional information of each of multiple liquid crystal pixels, and further looks up the first pixel signal to obtain a first voltage panel driving signal of the pixel; a determination module that determines whether each of the multiple liquid crystal pixels is a first-position liquid crystal pixel or a second-position liquid crystal pixel based on the positional information; a computation module that computes, when the liquid crystal pixel is a first-position liquid crystal pixel, a second pixel signal based on the first pixel signal and first voltage panel driving signal of the first-position liquid crystal pixel, and that computes, when the liquid crystal pixel is a second-position liquid crystal pixel, a first luminance signal based on the first voltage panel driving signals of the second-position liquid crystal pixel and of at least one first-position liquid crystal pixel adjacent to the second-position liquid crystal pixel; and a driving module that drives the first-position liquid crystal pixel using the second pixel signal and drives the second-position liquid crystal pixel using the first luminance signal.

In one embodiment, the computation module is configured to substitute the relevant parameters into the following formula to compute the second pixel signal:

$$R'_{ij}=R_{ij}-L_{ij};$$

where i represents the row position information of the liquid crystal pixel in a liquid crystal panel and j represents the column position information of the liquid crystal pixel in the liquid crystal panel; $R'_{ij}$ and $R_{ij}$ represent respectively the second pixel signal and the first pixel signal of the first-position liquid crystal pixel; $L_{ij}$ represents the first voltage panel driving signal of the first-position liquid crystal pixel.

Likewise, the computation module is further configured to substitute the relevant parameters into the following formula to compute the first luminance signal:

$$L'_{nm}=a*L_{nm}+b*(L_{n(m-1)}+L_{n(m+1)}L_{(n-1)m}+L_{(n+1)m})+c*(L_{(n-1)(m-1)}+L_{(n-1)(m+1)}+L_{(n+1)(m+1)}+L_{(n+1)(m-1)});$$

where n represents the row position information of the liquid crystal pixel in the liquid crystal panel and m represents the column position information of the liquid crystal pixel in the liquid crystal panel, while a, b and c denote weight factors; $L_{nm}$ and $L'_{nm}$ represents respectively the first voltage panel driving signal and the first luminance signal of the second-position liquid crystal pixel; and $L_{n(m-1)}$, $L_{n(m+1)}$, $L_{(n-1)m}$, $L_{(n+1)m}$, $L_{(n-1)(m-1)}$, $L_{(n-1)(m+1)}$, $L_{(n+1)(m+1)}$, and$L_{(n+1)(m-1)}$ represent respectively the first voltage panel driving signals of the first-position liquid crystal pixels adjacent to the second-position liquid crystal pixel.

In one embodiment, the driving device further includes a zero-value module that writes, if in computing the first luminance signal using the formula the corresponding liquid crystal pixel position of a first-position liquid crystal pixel in the formula doesn't exist in the liquid crystal panel, the corresponding first voltage panel driving signal of the non-existent liquid crystal pixel as 0.

In one embodiment, the driving device further includes: a partitioning module that divides the liquid crystal pixels in the liquid crystal panel into multiple array blocks, with each array block including four liquid crystal pixels adjacent to each other; and a setting module that sets any one liquid crystal pixel in each array block as a second-position liquid crystal pixel, and that arranges the second-position liquid crystal pixel in each block in a same position relative to the at least one first-position liquid crystal pixel in this block.

This disclosure further provides a liquid crystal display apparatus that includes the above-described driving device for driving a liquid crystal display apparatus.

In accordance with this disclosure, an image to be displayed is first received and then a first pixel signal and associated positional information of each of multiple liquid crystal pixels are obtained. Then the first pixel signal is looked up to retrieve a first voltage panel driving signal of this pixel. Based on the positional information, each liquid crystal pixel is determined as to whether it is a first-position liquid crystal pixel or a second-position liquid crystal pixel. When the liquid crystal pixel is a first-position liquid crystal pixel, the first pixel signal and first voltage panel driving signal of the first-position liquid crystal pixel would be based on to compute a second pixel signal. Otherwise when the liquid crystal pixel is a second-position liquid crystal pixel, the first voltage panel driving signals of the second-position liquid crystal pixel and of at least one first-position liquid crystal pixel adjacent to the second-position liquid crystal pixel are based on to compute a first luminance signal. The first-position liquid crystal pixel is then driven using the second pixel signal while the second-position pixel signal is driven using the first luminance signal. Thus, by applying grayscale compensation between the display brightnesses of adjacent liquid crystal pixels, the angular color shift can be advantageously so that the picture effects viewed in large viewing angles are substantially the same as the picture effects viewed in a normal viewing angle, hence improved display quality. The technical solutions according to this disclosure don't require designing primary and secondary pixels on the panel, thus eliminating the need of designing metal wires and thin film transistors intended for the purpose of driving the secondary pixels. This simplifies the manufacturing process and reduces the cost. The panel's transmittance is also improved due to the elimination of the secondary pixels.

BRIEF DESCRIPTION OF THE ACCOMPANYING DRAWINGS

To better illustrate the technical solutions that are reflected in various embodiments according to this disclosure or that are found in the prior art, the accompanying drawings intended for the description of the embodiments herein or of the prior art will now be briefly described. It is evident that the accompanying drawings listed in the following description show merely some embodiments of this disclosure, and that those having ordinary skill in the art will be able to obtain other drawings based on the steps shown in these drawings without making inventive efforts, where in the drawings:

FIG. 2 is a schematic diagram illustrating the distribution of first pixel signals in a scenario in which an image is displayed using one frame;

FIG. 3 is a schematic diagram illustrating the distribution of high-voltage panel signals in a scenario in which an image is displayed using two frames;

FIG. 4 is a schematic diagram illustrating the distribution of first voltage panel signals in the scenario in which an image is displayed using two frames;

FIG. 6 is a schematic diagram illustrating setting a position of a second-position liquid crystal pixel in each block in accordance with an embodiment of this disclosure;

FIG. 7 is a schematic diagram illustrating setting a position of a second-position liquid crystal pixel in each block in accordance with another embodiment this disclosure;

FIG. 8 is a schematic diagram illustrating setting a position of a second-position liquid crystal pixel in each block in accordance with still another embodiment of this disclosure;

FIG. 9 is a schematic diagram illustrating a position of a second-position liquid crystal pixel relative to at least one first-position liquid crystal pixels in each block in accordance with an embodiment of the disclosure;

FIG. 10 is a schematic diagram illustrating a weight scale factor of a second-position liquid crystal pixel and those of first-position liquid crystal pixels;

Figure 1:
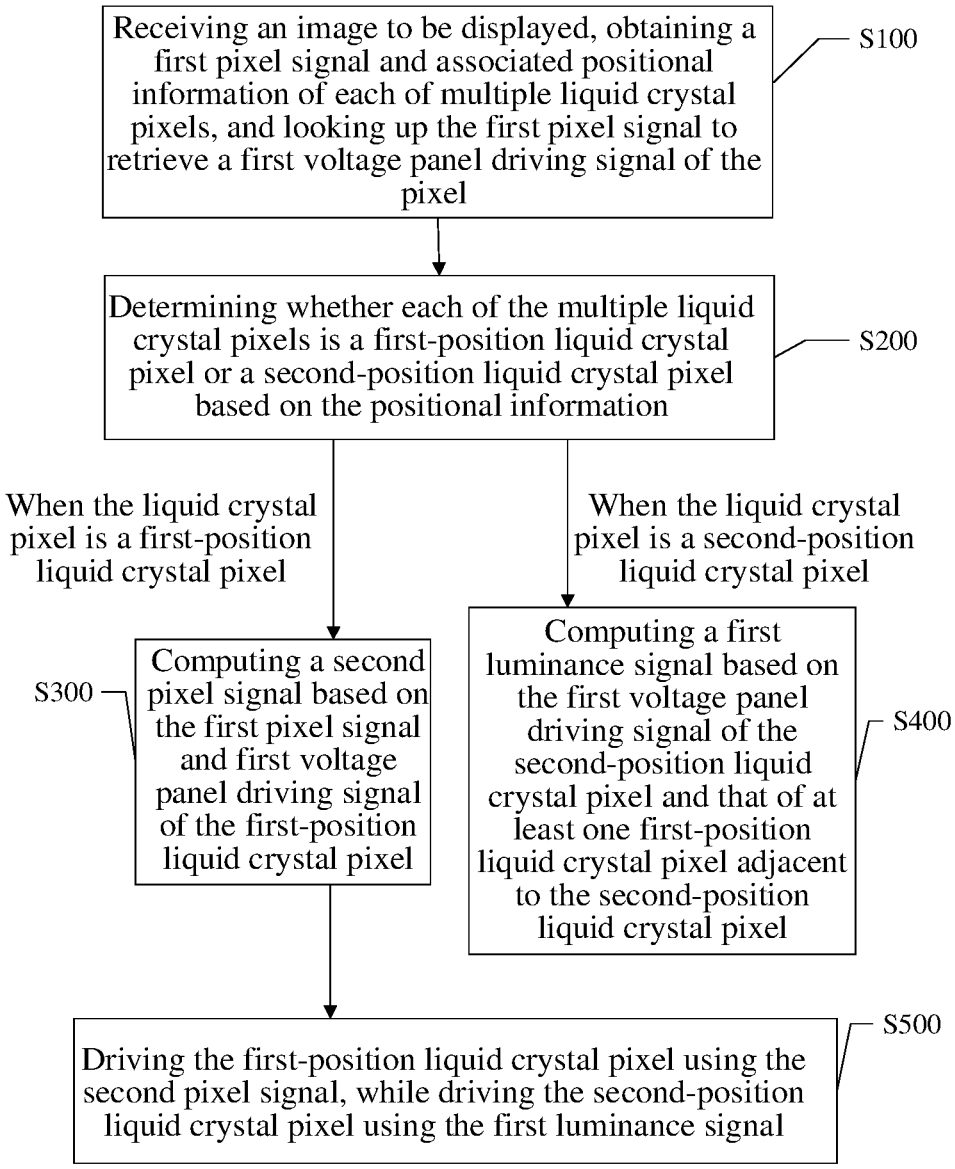
FIG. 1 is an illustrative flowchart of an embodiment of a driving method for driving a liquid crystal display apparatus in accordance with this disclosure.

Various implementations, functional features, and advantages of this disclosure will now be described in further detail in connection with some illustrative embodiments and the accompanying drawings.

DETAILED DESCRIPTION OF ILLUSTRATIVE EMBODIMENTS

Technical solutions reflected in various embodiments disclosed herein will now be described in a clear and comprehensive manner in connection with the accompanying drawings intended for these embodiments. It is evident that the described embodiments are merely some rather than all embodiments of this disclosure. All other embodiments obtained by persons having ordinary skill in the art based on the embodiments disclosed herein without making inventive efforts shall all fall within the scope of protection of this disclosure.

It should be noted that, all directional indicators (such as "up" "down" "left" "right" "front" or "rear") as used in the embodiments herein are merely used to illustrate the relative positions and movements or the like of various components or parts under a specific posture (as depicted in the drawings), and that should the specific posture change, these directional indicators will change accordingly.

As used herein, terms such as "first" or "second" are intended for illustrative purposes only and are not to be construed as indicating or implying their relative importance or implicitly indicating the number of the specified technical features. Thus, a feature modified by terms such as "first" or "second" can explicitly or implicitly include at least one of such a feature. In addition, technical solutions of various embodiments may be combined with one another, but such combinations must be premised on the achievability to those having ordinary skill in the art. Where a combination of technical solutions ends up contradictory or unachievable, such a combination shall not be regarded as existent nor would it fall within the scope of protection of this disclosure.

In this disclosure a driving method for driving a liquid crystal display apparatus is provided.

Referring to FIG. 1, the driving method for driving a liquid crystal panel according to this embodiment includes the following blocks which begin at block S100 and end at S500.

In S100, an image to be displayed is received. A first pixel signal and associated positional information of each of multiple liquid crystal pixels are obtained. The first pixel signal is then looked up to retrieve a first voltage panel driving signal of this pixel.

In S200, based on the positional information, each of the multiple liquid crystal pixels is determined as to whether it is a first-position liquid crystal pixel or a second-position liquid crystal pixel.

In S300, when the liquid crystal pixel is a first-position liquid crystal pixel, the first pixel signal and first voltage panel driving signal of the first-position liquid crystal pixel are based on to compute a second pixel signal.

In S400, when the liquid crystal pixel is a second-position liquid crystal pixel, the first voltage panel driving signals of the second-position liquid crystal pixel and of the at least one first-position liquid crystal pixel adjacent to the second-position liquid crystal pixel are based on to compute a first luminance signal.

In S500, the first-position liquid crystal pixel is driven by the second pixel signal, while the second-position liquid crystal pixel is driven by the first luminance signal.

It should be noted that, in the prior art the liquid crystal panel driving signals are high and low voltage signals that drive the image frames alternately. Referring to FIGS. 2 to 4, FIG. 2 illustrates displaying one image using one frame, where each R denotes a corresponding liquid crystal pixel driven by the first pixel signal.

FIGS. 3 and 4 illustrate displaying one image using two frames. In FIG. 3, each H represents a high-voltage panel signal that is used to drive the corresponding liquid crystal sub-pixel, while in FIG. 4 each L denotes a first voltage panel driving signal that is used to drive the corresponding liquid crystal sub-pixel.

The high-voltage panel driving signal RH/GH/BH and the first voltage panel driving signal RL/GL/BL are preset high and low voltage signals provided in advance base on the RGB input signals, and are determined according to the viewing angle effect that needs to be compensated for. The relevant data has been burned into the liquid crystal display apparatus at the production of the liquid crystal display apparatus. The high and low voltage signals typically are recorded in a hardware buffer in the form of a lookup table (LUT). For each R/G/B input signal, an 8-bit driving signal is used to input 0~255, i.e., a total of 256 high or low voltage signals, so there are a total of 3*256 pairs of high voltage signal RH/GH/BH and low voltage signal RL/GL/BL.

In a liquid crystal display apparatus, the display effects of the liquid crystal are determined by driving of both the panel driving signals and the luminance signal of the backlight source. In this embodiment, the luminance signal of the backlight source is not changed; only the panel driving signals are adjusted.

In accordance with this disclosure, the positional information of each liquid crystal pixel in the liquid crystal panel is configured in advance. The positional information specifies whether the liquid crystal pixel is a first-position liquid crystal pixel or a second-position liquid crystal pixel, where the second-position liquid crystal pixel is intended for color shift compensation. Then a first voltage panel driving signal and associated positional information of each liquid crystal pixel are obtained from the received image, where the first voltage panel driving signal is configured in advance and can be retrieved through a lookup when it needs to be obtained. Thus, the positional information of each liquid crystal pixel can be used to determine whether the liquid crystal pixel is a first-position liquid crystal pixel or a second-position liquid crystal pixel. When it is a first-position liquid crystal pixel, the first pixel signal and first voltage panel driving signal of the first-position liquid crystal pixel are based on to compute a second pixel signal. Otherwise when it is a second-position liquid crystal pixel, then the first voltage panel driving signal of the second-position liquid crystal pixel and those of the one or more first-position liquid crystal pixels adjacent to the second-position liquid crystal pixel are used to compute a first luminance signal for this second-position liquid crystal pixel. The technical solutions according to this disclosure don't require setting primary and secondary pixels on the panel, thus eliminating the need of designing metal wires and thin film transistors to fulfill the purpose of driving the secondary pixels. This simplifies the manufacturing process and reduces the cost. The panel's transmittance is also improved due to the elimination of the secondary pixels.

Figure 5:
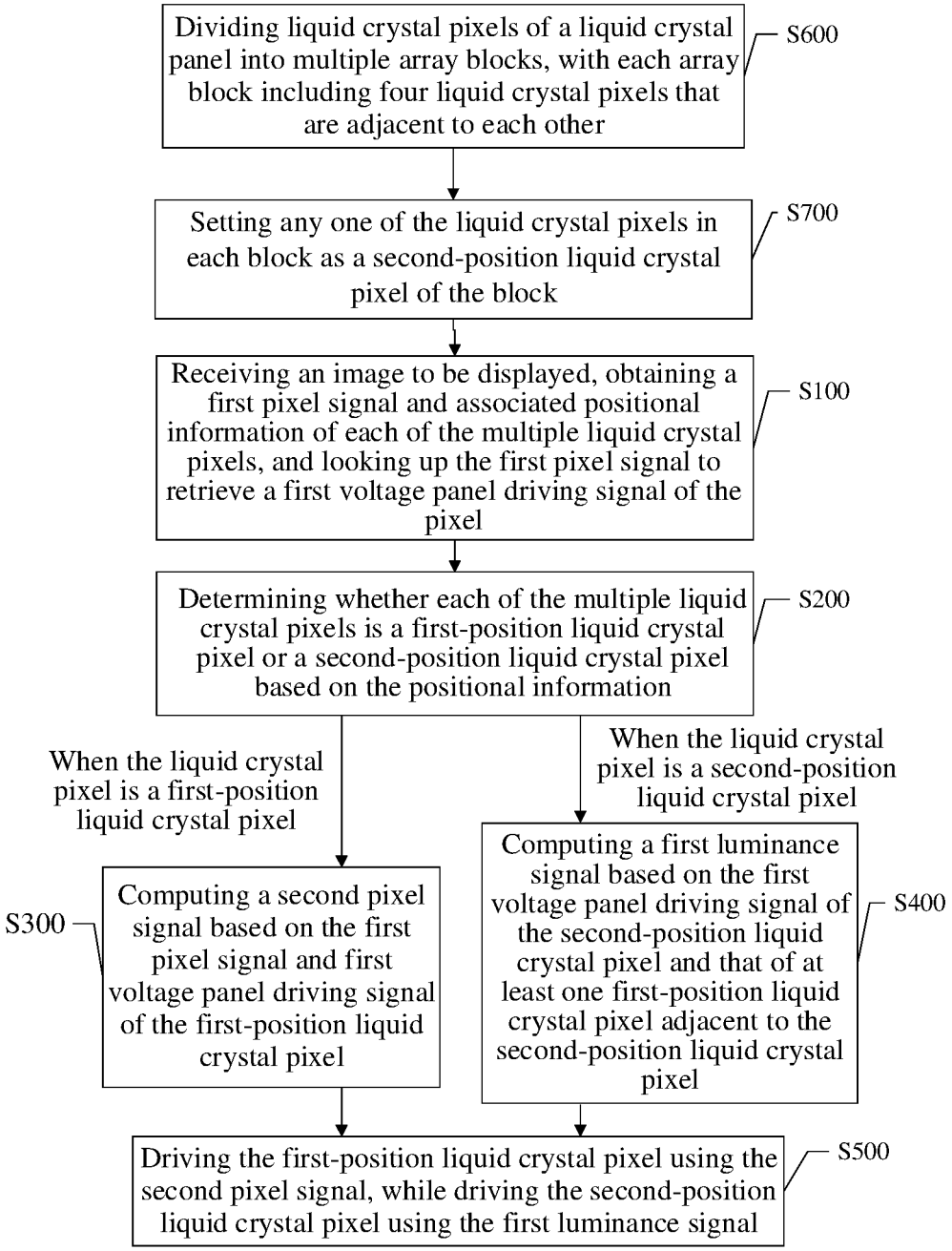
FIG. 5 is an illustrative flowchart of a further embodiment of the driving method for driving a liquid crystal display apparatus in accordance with this disclosure.

In another embodiment, as illustrated in FIG. 5, the method further includes the following operations: dividing the liquid crystal pixels in the liquid crystal panel into multiple array blocks, with each array block including four liquid crystal pixels adjacent to each other; and setting any one liquid crystal pixel in each block as a second-position liquid crystal pixel of this block.

In accordance with this disclosure, the liquid crystal pixels of the liquid crystal panel are divided into multiple blocks with each block being laid out in an array, and a second-position liquid crystal pixel at the same position in each block is selected for color shift compensation. From the received image, the first voltage panel driving signal of each liquid crystal pixel is obtained, where the first voltage panel driving signal is configured in advance and can be obtained through a lookup when needed. Thereafter, the first voltage panel driving signal of each second-position liquid crystal pixel and those of the one or more first-position liquid crystal pixel signals adjacent to the second-position liquid crystal pixel are based on to compute a first luminance signal, while the first pixel signal and first voltage panel driving signal of each first-position liquid crystal pixel are based on to compute a second pixel signal. The technical solutions according to this disclosure don't require setting primary and secondary pixels on the panel, thus eliminating the need of designing metal wires and thin film transistors to fulfill the purpose of driving the secondary pixels. This simplifies the manufacturing process and reduces the cost. The panel's transmittance is also improved due to the elimination of the secondary pixels.

Depending on the number of liquid crystal pixels in each array block, the following embodiments are included.

Referring to FIG. 6, in one embodiment, setting the second-position liquid crystal pixels and the first-position liquid crystal pixels includes the following operations.

Every two adjacent liquid crystal pixels are taken as one block, and any one of the liquid crystal pixels in the block is selected as the second position liquid crystal pixel. As illustrated in FIG. 6, each L' indicates driving with a first luminance signal, and each R' indicating driving with a second pixel signal. In this embodiment, liquid crystal pixels of the liquid crystal panel are driven by multiple L's and R's at the same time, while other liquid crystal pixels would be driven by their respective pixel signals, so that one image is displayed using one frame.

Here, every two adjacent liquid crystal pixels in the horizontal direction counts as one block; in such a manner the entire liquid crystal panel can be divided into multiple block arrays. The liquid crystal pixel at a certain position in each block is selected as the second-position liquid crystal pixel of this block. The liquid crystal pixel at a same position in each block is selected as the second-position liquid crystal pixel. As such, based on the first voltage panel driving signals of the second-position liquid crystal pixel and of the one or more first-position liquid crystal pixels adjacent to the second-position liquid crystal pixel, the first luminance signal can be computed. In addition, the first pixel signal and first voltage panel driving signal of each first-position liquid crystal pixel are based on to compute the second pixel signal. Thereafter, the first luminance signal and the second pixel signal are used respectively to drive the two types of pixels.

In another embodiment, setting the second-position liquid crystal pixels and the first-position liquid crystal pixels may include the following operations.

Every nine adjacent liquid crystal pixels are taken as one block, and the liquid crystal pixel located in the center of the block is selected as the second-position liquid crystal pixel. As illustrated in FIG. 7, L' indicates driving with a first luminance signal, and R' indicates driving with a second pixel signal. In this embodiment, liquid crystal pixels of the liquid crystal panel are driven by multiple L's and R's at the same time, while other liquid crystal pixels would be driven by their respective pixel signals, so that one image is displayed using one frame.

Here, nine adjacent liquid crystal pixels are taken as one block, with the nine liquid crystal pixels arranged in three rows and three columns. The liquid crystal pixel at a same position in each block is selected as the second-position liquid crystal pixel of this block. As such, based on the first voltage panel driving signals of the nine liquid crystal pixels, the first luminance signal for the second-position liquid crystal pixel is computed. In addition, the first pixel signal and first voltage panel driving signal of each first-position liquid crystal pixel are based on to compute the second pixel signal. Thereafter, the first luminance signal and the second pixel signal are used respectively to drive the two types of pixels.

In still another embodiment, setting the second-position liquid crystal pixels and the first-position liquid crystal pixels may include the following operations.

Every four adjacent liquid crystal pixels are taken as one block, and any one of the liquid crystal pixels in the block is selected as the second position liquid crystal pixel of this block.

Further, setting any one of the liquid crystal pixels in each block as the second-position liquid crystal pixel of this block includes the following operations: setting the second-position liquid crystal pixel in each block in a position relative to at least one first-position liquid crystal pixel of this block.

As illustrated in FIG. 8, each L' indicates driving with a first luminance signal, and each R' indicates driving with a second pixel signal. In this embodiment, liquid crystal pixels of the liquid crystal panel are driven by multiple L's and R's at the same time, while other liquid crystal pixels would be driven by their respective pixel signals, so that one image is displayed using one frame.

Here, every four adjacent liquid crystal pixels are taken as one block, with the four liquid crystal pixels sitting at the four vertices of a square. The liquid crystal pixel at the same position in each block is selected as the second-position liquid crystal pixel of this block. As such, based on the first voltage panel driving signals of the second-position liquid crystal pixel and of the at least one first-position liquid crystal pixel adjacent to the second-position liquid crystal pixel, the first luminance signal is computed. In addition, the first pixel signal and first voltage panel driving signal of the first-position liquid crystal pixel are based on to compute the second pixel signal. Thereafter, the first luminance signal and the second pixel signal are used respectively to drive the two types of pixels.

Further, computing the first luminance signal when the liquid crystal pixel is a second-position liquid crystal pixel includes substituting the relevant parameters into the following formula to compute the first luminance signal:

$$L'_{nm}=a*L_{nm}+b*(L_{n(m-1)}+L_{n(m+1)}+L_{(n-1)m}+L_{(n+1)m})+c*(L_{(n-1)(m-1)}+L_{(n-1)(m+1)}+L_{(n+1)(m+1)}+L_{(n+1)(m-1)});$$

where n represents the row position information of the liquid crystal pixel in the liquid crystal panel and m represents the column position information of the liquid crystal pixel in the liquid crystal panel, while a, b and c denote weight factors; $L_{nm}$ and $L'_{nm}$ represent respectively the first voltage panel driving signal and the first luminance signal of the second-position liquid crystal pixel; and $L_{n(m-1)}$, $L_{n(m+1)}$, $L_{(n-1)m}$, $L_{(n+1)m}$, $L_{(n-1)(m-1)}$, $L_{(n-1)(m+1)}$, $L_{(n+1)(m+1)}$, and $L_{(n+1)(m-1)}$ represent respectively the first voltage panel driving signals of the first-position liquid crystal pixels adjacent to the second-position liquid crystal pixel.

As illustrated in FIG. 8, each L' indicates driving with a first luminance signal, while each R' indicates driving with a second pixel signal. In this embodiment, liquid crystal pixels of the liquid crystal panel are driven by multiple L's and R's at the same time, while other liquid crystal pixels would be driven by their respective pixel signals, so that one image is displayed using one frame.

In computing the first luminance signal of the second-position liquid crystal pixel, the second-position liquid crystal pixel, taken as the center, constitute a block together with its adjacent first-position liquid crystal pixels. Due to the differences in their positions, the first-position liquid crystal pixels would exert different degrees of influence on the second-position liquid crystal pixel. Accordingly, in one embodiment, a weight factor is used to indicate the strength of influence of a first-position liquid crystal pixel on the second-position liquid crystal pixel. In particular, a weight factor b is assumed for each of the first-position liquid crystal pixels side-adjacent to the second-position liquid crystal pixel, a weight factor c is assumed for each of the first-position liquid crystal pixels diagonal-adjacent to the second-position liquid crystal pixel, where $L_{nm}$ represents the first voltage panel driving signal of the second-position liquid crystal pixel, and $L'_{nm}$ represents the first luminance signal of the second-position liquid crystal pixel that is desired to be computed.

As illustrated in FIG. 9, there is shown the relative position of a second-position liquid crystal pixel with reference to the first-position liquid crystal pixels. In one embodiment, if in computing the first luminance signal using the formula the corresponding liquid crystal pixel position of a first-position liquid crystal pixel in the formula doesn't exist in the liquid crystal panel, then the corresponding first voltage panel driving signal of the non-existent liquid crystal pixel is written as 0.

In one embodiment, the weight factors a=1, b=0.5, and c=0.25.

Referring now to FIG. 10, there is shown a schematic diagram illustrating the weight scale factors of all the second-position liquid crystal pixel and first-position liquid crystal pixels in the liquid crystal panel.

It should be noted that computing the first luminance signals is essentially computing the compensatory low voltage signals that theoretically needs to be provided respectively to all the liquid crystal pixels in each unit, so as to weight the actual positional influences of the corresponding positions of the first-position liquid crystal pixels of the unit on the second-position liquid crystal pixel, in order that the compensation effects fulfilled by the low-brightness liquid crystal pixel signals can be consistent with the effects of the average compensatory signals required by the unit. The adjustment of the weight also reflects the grayscale signal for the liquid crystal pixel that needs to be fed to the corresponding real image of the liquid crystal pixel position.

In addition, computing the second pixel signal when the liquid crystal pixel is a first-position liquid crystal pixel may include substituting the relevant parameters into the following formula to compute the second pixel signal:

$$R'_{ij}=R_{ij}-L_{ij};$$

where i represents the row position information of the liquid crystal pixel in the liquid crystal panel and j represents the column position information of the liquid crystal pixel in the liquid crystal panel; $R'_{ij}$ and $R_{ij}$ represent respectively the second pixel signal and the first pixel signal of the first-position liquid crystal pixel; $L_{ij}$ represents the first voltage panel driving signal of the first-position liquid crystal pixel.

Taking nine liquid crystal pixels as one unit, for example, the weight assigned to the position displaying the first luminance signal is 1, indicating the position is actually the most influential. The first-position liquid crystal pixels sitting at the four positions, i.e., to the upper, to the lower, to the left, and to the right of the second-position liquid crystal pixel is also adjacent to other second-position liquid crystal pixels, so that these four first-position liquid crystal pixels are each assigned a secondary weight 0.5. Similarly, the first-position liquid crystal pixels at the four corners of the second-position liquid crystal pixel also are diagonally adjacent to other second-position liquid crystal pixels, so each of these four first-position liquid crystal pixels are assigned a secondary weight 0.25. This can not only realistically reflect the true representative signal that should be reflected by the position displaying a low gray scale, but can provide a reasonable brightness distribution for the surrounding liquid crystal pixels. The second pixel signal of the first-position liquid crystal pixel is obtained by subtracting the first voltage panel driving signal from the first pixel signal of the first-position liquid crystal pixel itself.

The technical solution of the present disclosure is applicable to solving the defect of angular color shift of TN, OCB, and VA TFT liquid crystal panels. The backlight brightness is compensated for and adjusted by using direct-lit or side backlight, white light, or RGB three-color light source in combination with the high first voltage panel driving signal, thus reducing the flicker phenomenon caused by the difference in switching between the high and low panel voltage driving signals, while retaining the advantage of maintaining high and low liquid crystal voltages to compensate for angular color shift. Second, the pixels are no longer designed as primary pixels and secondary pixels, so that the transmittance of the TFT liquid crystal panel can be greatly improved, reducing the backlight cost. In development of high-resolution TFT LCD panels, the improvement of transmittance and resolution can be more significant with the pixels no longer needing to be designed as primary and secondary pixels.

Figure 11:
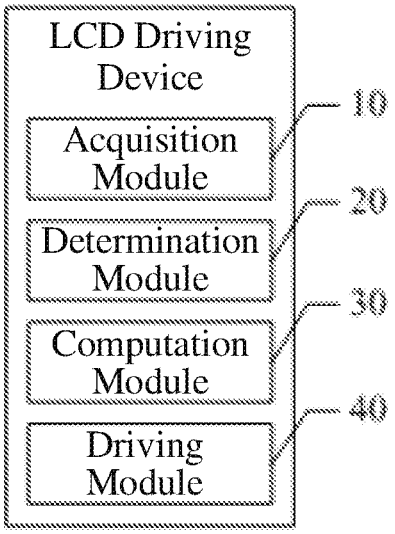
FIG. 11 is an illustrative functional block diagram of an embodiment of a driving device for driving a liquid crystal display apparatus in accordance with this disclosure.

Referring now to FIG. 11, this disclosure also provides a driving device for driving a liquid crystal panel, which may be a television, a computer, or the like. The driving device for driving the liquid crystal panel includes an acquisition module 10, a determination module 20, a computation module 30, and a driving module 40.

The acquisition module 10 can be configured to receive an image to be displayed, obtain a first pixel signal and associated positional information of each of multiple liquid crystal pixels, and further look up the first pixel signal to retrieve a first voltage panel driving signal of the pixel.

The determination module 20 can be configured to determine whether each of the multiple liquid crystal pixels is a first-position liquid crystal pixel or a second-position liquid crystal pixel based on the positional information.

The computation module 30 can be configured to: compute, when the liquid crystal pixel is a first-position liquid crystal pixel, a second pixel signal based on the first pixel signal and first voltage panel driving signal of the first-position liquid crystal pixel; and compute, when the liquid crystal pixel is a second-position liquid crystal pixel, a first luminance signal based on the first voltage panel driving signals of the second-position liquid crystal pixel and of the at least one first-position liquid crystal pixels adjacent to the second-position liquid crystal pixel.

The driving module 40 can be configured to drive the first-position liquid crystal pixel using the second pixel signal, and drive the second-position liquid crystal pixel using the first luminance signal.

In one embodiment, the computation module 30 is configured to substitute the relevant parameters into the following formula to compute the second pixel signal:

$$L'_{nm}=a*L_{nm}+b*(L_{n(m-1)}+L_{n(m+1)}+L_{(n-1)m}+L_{(n+1)m}(+c*(L_{(n-1(m-1)}+L_{(n-1)(m+1)}+L_{(n+1)(m+1)}+L_{(n+1)(m-1)});$$

where n represents the row position information of the liquid crystal pixel in a liquid crystal panel and m represents the column position information of the liquid crystal pixel in the liquid crystal panel, while a, b and c denote weight factors; $L_{nm}$ and $L'_{nm}$ represents respectively the first voltage panel driving signal and the first luminance signal of the second-position liquid crystal pixel; and $L_{n(m-1)}$, $L_{n(m+1)}$, $L_{(n-1)m}$, $L_{(n+1)m}$, $L_{(n-1)(m-1)}$, $L_{(n-1)(m+1)}$, $L_{(n+1)(m+1)}$, and $L_{(n+1)(m-1)}$ represent respectively the first voltage panel driving signals of the first-position liquid crystal pixels adjacent to the second-position liquid crystal pixel.

Figure 12:
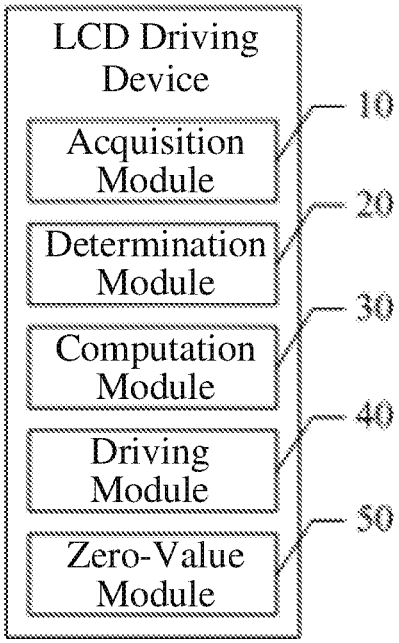
FIG. 12 is an illustrative functional block diagram of another embodiment of a driving device for driving a liquid crystal display apparatus in accordance with this disclosure.

Referring to FIG. 12, in one embodiment, the driving device for driving the liquid crystal panel further includes a zero-value module 50 configured to write, if in computing the first luminance signal using the formula the corresponding liquid crystal pixel position of a first-position liquid crystal pixel in the formula doesn't exist in the liquid crystal panel, the corresponding first voltage panel driving signal of the non-existent liquid crystal pixel position as 0.

In one embodiment, the weight factors a=1, b=0.5, and c=0.25.

In one embodiment, the computation module 30 is further configured to substitute the relevant parameters into the following formula to compute the second pixel signal:

$$R'_{nm}=R_{nm}-L_{nm};$$

where n represents the row position information of the liquid crystal pixel in the liquid crystal panel and m represents the column position information of the liquid crystal pixel in the liquid crystal panel; $R'_{nm}$ and $R_{nm}$ represent respectively the second pixel signal and the first pixel signal of the first-position liquid crystal pixel; and $L_{nm}$ represents the first voltage panel driving signal of the first-position liquid crystal pixel.

Figure 13:
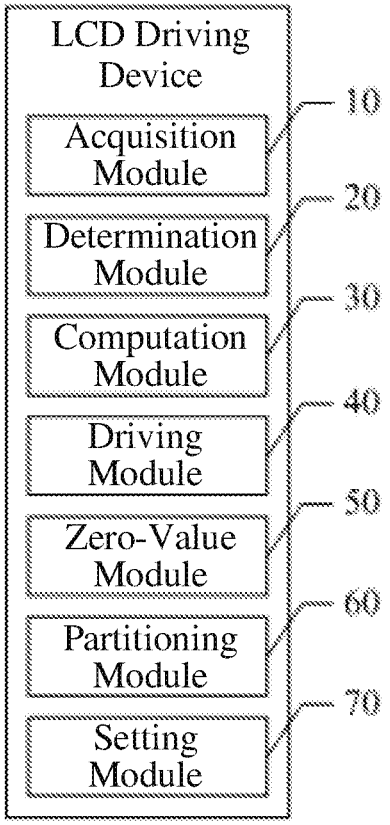
FIG. 13 is an illustrative functional block diagram of still another embodiment of a driving device for driving a liquid crystal display apparatus in accordance with this disclosure.

Referring to FIG. 13, in one embodiment, the driving device for driving the liquid crystal panel further includes a partitioning module 60 and a setting module 70.

The partitioning module 60 can be configured to divide the liquid crystal pixels of the liquid crystal panel into multiple array blocks with each array block including four liquid crystal pixels adjacent to each other.

The setting module 70 can be configured to set any one liquid crystal pixel in each array block as a second-position liquid crystal pixel of this array block.

In one embodiment, the setting module 70 can further be configured to set the second-position liquid crystal pixel in each block in a same position relative to the one or more first-position liquid crystal pixels in this block.

It will be appreciated by those having ordinary skill in the art that this disclosure also can provide a driving device for driving a liquid crystal display apparatus that includes: a non-volatile memory storing executable instructions; and a processor that executes the executable instructions to perform the methods according to the embodiments described supra. Those having ordinary skill in the art will further appreciate that, the modules/units shown in FIGS. 11 to 13 of this disclosure, including the acquisition module 10, the determination module 20, the computation module 30, the driving module 40, the zero-value module 50, the partitioning module 60, and the setting module 70, can be software modules or software units. In addition, various software modules or software units inherently can be stored in non-volatile memory and executed by a processor.

Figure 14:
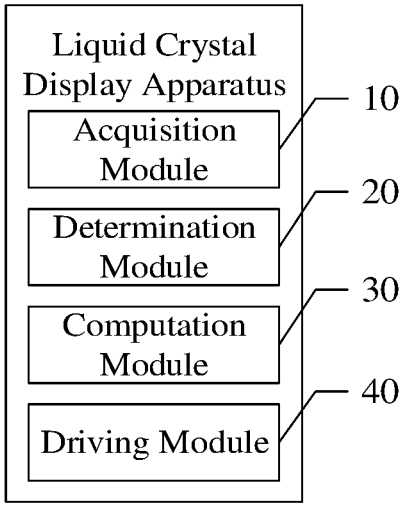
FIG. 14 is an illustrative functional block diagram of an embodiment of a liquid crystal display apparatus in accordance with this disclosure.
Figure 15:
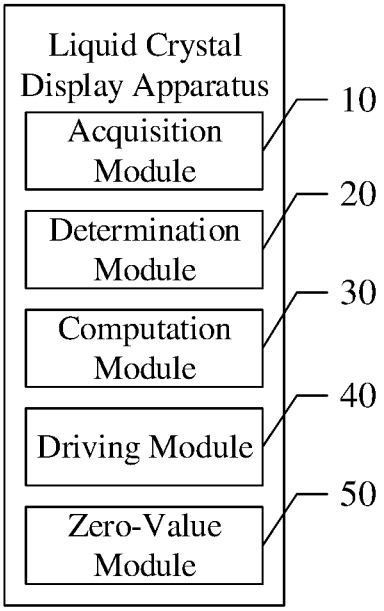
FIG. 15 is an illustrative functional block diagram of another embodiment of a liquid crystal display apparatus in accordance with this disclosure.
Figure 16:
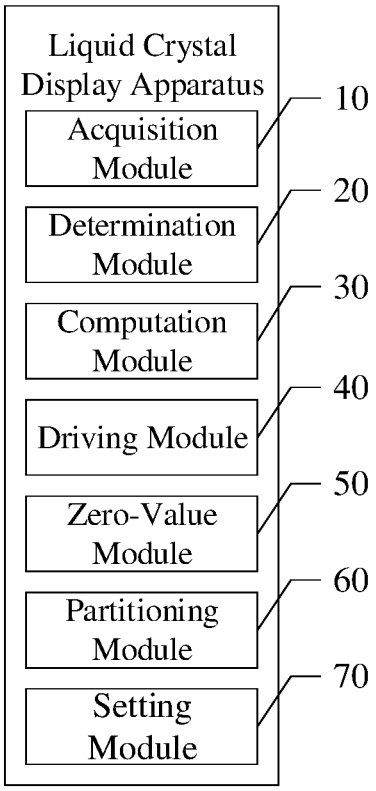
FIG. 16 is an illustrative functional block diagram of still another embodiment of a liquid crystal display apparatus in accordance with this disclosure.

This disclosure further provides a liquid crystal display apparatus having structures as illustrated in FIGS. 14, 15, and 16. The liquid crystal display apparatus includes the above-described driving device for driving a liquid crystal panel; for the specific structure of the driving device, see the foregoing embodiments. Since it adopts all the technical solutions of all the embodiments described supra, the liquid crystal display apparatus would have all the benefits brought by the technical solutions of the above embodiments; these benefits, however, are not to be detailed herein again.

The liquid crystal display apparatus may be a tablet computer display, a television display, a computer display, or the like.

The foregoing merely depicts some illustrative embodiments according to this disclosure and therefore is not intended to limit the scope of the protection of this disclosure. Under the inventive concept of this disclosure, any equivalent structural changes based on the specification and accompanying drawings of the disclosure and any direct/indirect applications of this disclosure on other related technical fields shall all be compassed within the scope of protection of this disclosure.

What is claimed is:

1. A driving method for driving a liquid crystal display apparatus, comprising:

receiving an image to be displayed, obtaining a first pixel signal and associated positional information of each of a plurality of liquid crystal pixels, and looking up the first pixel signal to retrieve a first voltage panel driving signal of the liquid crystal pixel;

determining whether each of the plurality of liquid crystal pixels is a first-position liquid crystal pixel or a second-position liquid crystal pixel based on the positional information;

when the liquid crystal pixel is a first-position liquid crystal pixel, computing a second pixel signal based on the first pixel signal and first voltage panel driving signal of the first-position liquid crystal pixel;

otherwise when the liquid crystal pixel is a second-position liquid crystal pixel, computing a first luminance signal based on the first voltage panel driving signal of the second-position liquid crystal pixel and that of at least one first-position liquid crystal pixel adjacent to the second-position liquid crystal pixel; and driving the first-position liquid crystal pixel by the second pixel signal, and driving the second-position liquid crystal pixel by the first luminance signal, and wherein computing the second pixel signal when the liquid crystal pixel is a first-position liquid crystal pixel comprises substituting relevant parameters into the following formula to compute the second pixel signal:

$$R'ij=Rij-Lij;$$

where i represents row position information of the liquid crystal pixel in a liquid crystal panel and j represents column position information of the pixel in the liquid crystal panel; R'ij and Rij represent respectively the second pixel signal and the first pixel signal of the first-position liquid crystal pixel; and Lij represents the first voltage panel driving signal of the first-position liquid crystal pixel;

and wherein computing the first luminance signal when the liquid crystal pixel is a second-position liquid crystal pixel comprises substituting relevant parameters into the following formula to compute the first luminance signal:

$$L'nm=a*Lnm+b*(Ln(m-1)+Ln(m+1)+L(n-1)m+L(n+1)m)+c*(L(n-1)(m-1)+L(n-1)(m+1)+L(n+1)(m+1)+L(n+1)(m-1));$$

where n represents row position information of the liquid crystal pixel in the liquid crystal panel and m represents column position information of the liquid crystal pixel in the liquid crystal panel, while a, b, and c denote weight factors; Lnm and L'nm represent respectively the first voltage panel driving signal and the first luminance signal of the second-position liquid crystal pixel; and Ln(m−1), Ln(m+1), L(n−1)m, L(n+1)m, L(n−1)(m−1), L(n−1)(m+1), L(n+1)(m+1), and L(n+1)(m−1) represent respectively the first voltage panel driving signals of the at least one first-position liquid crystal pixel adjacent to the second-position liquid crystal pixel.

2. The driving method of claim 1, further comprising:

if in computing the first luminance signal using the formula the corresponding liquid crystal pixel position of a first-position liquid crystal pixel in the formula doesn't exist in the liquid crystal panel, writing a corresponding first voltage panel driving signal of the non-existent liquid crystal pixel position as 0.

3. The driving method of claim 1, wherein the weight factors a=1, b=0.5, and c=0.25.

4. The driving method of claim 2, wherein the weight factors a=1, b=0.5, and c=0.25.

5. The driving method of claim 1, further comprising:

dividing the plurality of liquid crystal pixels of a liquid crystal panel into a plurality of array blocks, with each array block including four liquid crystal pixels that are adjacent to each other;

setting any one of the liquid crystal pixels in each block as a second-position liquid crystal pixel of the block; and setting the second-position liquid crystal pixel of each block in a same position relative to the at least one first-position liquid crystal pixel of the block.

6. The driving method of claim 1, further comprising:

dividing the plurality of liquid crystal pixels of a liquid crystal panel into a plurality of array blocks, with each array block including four liquid crystal pixels that are adjacent to each other;

setting any one of the liquid crystal pixels in each block as a second-position liquid crystal pixel of the block; and setting the second-position liquid crystal pixel of each block in a same position relative to the at least one first-position liquid crystal pixel of the block.

7. A driving device for driving a liquid crystal display apparatus, comprising:

a processor and a memory, wherein the memory stores one or more programs including instructions that, when executed by the processor, cause the driving device to:

receive an image to be displayed, obtain a first pixel signal and associated positional information of each of a plurality of liquid crystal pixels, and look up the first pixel signal to retrieve a first voltage panel driving signal of the liquid crystal pixel;

determine whether each of the plurality of liquid crystal pixels is a first-position liquid crystal pixel or a second-position liquid crystal pixel based on the positional information;

compute, when the liquid crystal pixel is a first-position liquid crystal pixel, a second pixel signal based on the first pixel signal and first voltage panel driving signal of the first-position liquid crystal pixel; and compute, when the liquid crystal pixel is a second-position liquid crystal pixel, a first luminance signal based on the first voltage panel driving signal of the second-position liquid crystal pixel and that of at least one first-position liquid crystal pixel adjacent to the second-position liquid crystal pixel; and drive the first-position liquid crystal pixel using the second pixel signal, and drive the second-position liquid crystal pixel using the first luminance signal, and wherein execution of the instructions cause the driving device to further:

substitute relevant parameters into the following formula to compute the second pixel signal:

$$R'ij=Rij-Lij$$

where i represents row position information of the liquid crystal pixel in a liquid crystal panel and j represents column position information of the pixel in the liquid crystal panel; R'ij and Rij represent respectively the second pixel signal and the first pixel signal of the first-position liquid crystal pixel; and Lij represents the first voltage panel driving signal of the first-position liquid crystal pixel;

and substitute relevant parameters into the following formula to compute the first luminance signal:

$$L'nm=a*Lnm+b*(Ln(m-1)+Ln(m+1)+L(n-1)m+L(n+1)m)+c*(L(n-1)(m-1)+L(n-1)(m+1)+L(n+1)(m+1)+5L(n+1)(m-1));$$

where n represents row position information of the liquid crystal pixel in the liquid crystal panel and m represents column position information of the liquid crystal pixel in the liquid crystal panel, while a, b, and c denote weight factors; Lnm and L'nm represent respectively the first voltage panel driving signal and the first luminance signal of the second-position liquid crystal pixel; and Ln(m−1), Ln(m+1), L(n+l)m, L(n−1)(m−1), L(n−1)(m+1), L(n+1)(m+1), and L(n+1)(m−1) represent respectively the first voltage panel driving signals of the at least one first-position liquid crystal pixel adjacent to the second-position liquid crystal pixel.

8. The driving device of claim 7, wherein the execution of the instructions cause the driving device to further:

write, if in computing the first luminance signal using the formula the corresponding liquid crystal pixel position of a first-position liquid crystal pixel in the formula doesn't exist in the liquid crystal panel, a corresponding first voltage panel driving signal of the non-existent liquid crystal pixel position as 0.

9. The driving device of claim 7, wherein the weight factors a=1, b=0.5, and c=0.25.

10. The driving device of claim 8, wherein the weight factors a=1, b=0.5, and c=0.25.

11. The driving device of claim 7, wherein the execution of the instructions cause the driving device to further:

divide the plurality of liquid crystal pixels of a liquid crystal panel into a plurality of array blocks, with each array block including four liquid crystal pixels that are adjacent to each other; and set any one of the liquid crystal pixels in each array block as a second-position liquid crystal pixel of the block; and set the second-position liquid crystal pixel of each block in a same position relative to the at least one first-position liquid crystal pixel of the block.

12. The driving device of claim 7, wherein the execution of the instructions cause the driving device to further:

divide the plurality of liquid crystal pixels of a liquid crystal panel into a plurality of array blocks, with each array block including four liquid crystal pixels that are adjacent to each other; and set any one of the liquid crystal pixels in each array block as a second-position liquid crystal pixel of the block; and set the second-position liquid crystal pixel of each block in a same position relative to the at least one first-position liquid crystal pixel of the block.

13. A liquid crystal display apparatus comprising a driving device for driving the liquid crystal display apparatus, the driving device comprising a processor and a memory storing one or more executable instructions when executed by the processor, cause the driving device to:

receive an image to be displayed, obtain a first pixel signal and associated positional information of each of a plurality of liquid crystal pixels, and look up the first pixel signal to retrieve a first voltage panel driving signal of the liquid crystal pixel;

determine whether each of the plurality of liquid crystal pixels is a first-position liquid crystal pixel or a second-position liquid crystal pixel based on the positional information;

compute, when the liquid crystal pixel is a first-position liquid crystal pixel, a second pixel signal based on the first pixel signal and first voltage panel driving signal of the first-position liquid crystal pixel; and compute, when the liquid crystal pixel is a second-position liquid crystal pixel, a first luminance signal based on the first voltage panel driving signal of the second-position liquid crystal pixel and that of at least one first-position liquid crystal pixel adjacent to the second-position liquid crystal pixel; and drive the first-position liquid crystal pixel using the second pixel signal, and drive the second-position liquid crystal pixel using the first luminance signal and wherein execution of the instructions cause the driving device to further:

substitute relevant parameters into the following formula to compute the second pixel signal:

$$R'ij=Rij-Lij$$

where i represents row position information of the liquid crystal pixel in a liquid crystal panel and j represents column position information of the pixel in the liquid crystal panel; R'ij and Rij represent respectively the second pixel signal and the first pixel signal of the first-position liquid crystal pixel; and Lij represents the first voltage panel driving signal of the first-position liquid crystal pixel;

and substitute relevant parameters into the following formula to compute the first luminance signal:

$$L'nm=a*Lnm+b*(Ln(m-1)+Ln(m+1)+L(n-1)m+L(n+1)m)+c*(L(n-1)(m-1)+L(n-1)(m+1)+L(n+1)(m+1)+L(n+1)(m-1));$$

where n represents row position information of the liquid crystal pixel in the liquid crystal panel and m represents column position information of the liquid crystal pixel in the liquid crystal panel, while a, b, and c denote weight factors; Lnm and L'nm represent respectively the first voltage panel driving signal and the first luminance signal of the second-position liquid crystal pixel; and Ln(m−1), Ln(m+1), L(n−1)m, L(n+1)m, L(n−1)(m−1), L(n−1)(m+1), L(n+1)(m+1), and L(n+1)(m−1) represent respectively the first voltage panel driving signals of the at least one first-position liquid crystal pixel adjacent to the second-position liquid crystal pixel.

14. The liquid crystal display apparatus of claim 13, wherein the execution of the instructions cause the driving device to further:

write, if in computing the first luminance signal using the formula the corresponding liquid crystal pixel position of a first-position liquid crystal pixel in the formula doesn't exist in the liquid crystal panel, a corresponding first voltage panel driving signal of the non-existent liquid crystal pixel position as 0.

15. The liquid crystal display apparatus of claim 13, wherein the weight factors a=1, b=0.5, and c=0.25.

16. The liquid crystal display apparatus of claim 14, wherein the weight factors a=1, b=0.5, and c=0.25.

17. The liquid crystal display apparatus of claim 13, wherein the execution of the instructions cause the driving device to further:

divide the plurality of liquid crystal pixels of a liquid crystal panel into a plurality of array blocks, with each array block including four liquid crystal pixels that are adjacent to each other; and set any one of the liquid crystal pixels in each array block as a second-position liquid crystal pixel of the block; and set the second-position liquid crystal pixel of each block in a same position relative to the at least one first-position liquid crystal pixel of the block.

* * * * *